US006171126B1

(12) United States Patent
Wu et al.

(10) Patent No.: US 6,171,126 B1
(45) Date of Patent: Jan. 9, 2001

(54) BATTERY RECEPTACLE CONNECTOR

(75) Inventors: Jerry Wu, Chang-Hua; Allen Chiu; Kelly Shih, both of Tu-Chen, all of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/398,318

(22) Filed: Sep. 16, 1999

(30) Foreign Application Priority Data

Dec. 28, 1998 (TW) ..... 87221633

(51) Int. Cl.[7] ..... H01R 27/00
(52) U.S. Cl. ..... 439/224; 439/733.1; 439/857
(58) Field of Search ..... 439/224, 682, 439/733.1, 857, 856

(56) References Cited

U.S. PATENT DOCUMENTS 4,655,522 * 4/1987 Beck, Jr. et al. ..... 439/224
4,717,354 * 1/1988 McCleerey ..... 439/733.1
4,820,179 * 4/1989 Saijo ..... 439/224
5,135,418 * 8/1992 Hatagishi et al. ..... 439/857

* cited by examiner

*Primary Examiner*—Gary F. Paumen
(74) *Attorney, Agent, or Firm*—Wei Te Chung

(57) ABSTRACT

A battery receptacle connector comprises a dielectric housing forming a number of parallel terminal receiving grooves with a terminal received in each groove. Adjacent grooves are spaced by a partition. The housing further defines first and second engaging slots in communication with each groove for securing the corresponding terminal therein. Each terminal comprises a base, a tail portion downwardly extending from the base, positioning means consisting of a first positioning member and a second positioning member, a pair of cantilevered arms upwardly extending from the base, and a mating portion consisting of a first mating member and a second mating member. The first positioning member upwardly extends from the base opposite the tail portion, and the second positioning member forwardly extends from the base. The first and second positioning members are respectively received in the first and second engaging slots of the housing and anchor the terminal within the corresponding terminal receiving groove thereby preventing the terminals from becoming adversely affected by deflection and mechanical shock. The first and second mating members allow a mating plug connector to engage with the battery receptacle connector in more than one direction.

11 Claims, 3 Drawing Sheets

2

BATTERY RECEPTACLE CONNECTOR

BACKGROUND OF THE INVENTION

The present invention relates to a battery receptacle connector, and particularly to a battery receptacle connector having a plurality of terminals firmly fixed in a dielectric housing and electrically connecting with a mating plug connector from more than one direction.

A conventional battery receptacle connector electrically connects a battery to a note-book computer or other electronic instrument for transmitting a current. Thus, the battery receptacle connector requires a relative large contact area between the engaged male terminals and female terminals, and together with a substantial normal contact force thereby decreasing contact impedance and heat resulting from the mating process.

A related conventional battery receptacle connector is disclosed in Taiwan Patent Application No. 84210634. Each terminal of the conventional battery receptacle connector forms a projecting rectangle for increasing the contact area thereof, but only has a single contact surface. Thus, the conventional battery receptacle connector does not provide a sufficient normal contact force to ensure reliable current transmission. In addition, in the general case, the terminals of the battery receptacle connector are often subject to mechanical shock due to repeated insertions/withdrawals, and often have a large mating resistance. Therefore, the terminals must be firmly fixed to a dielectric housing to withstand deflection and mechanical shock while still providing a normal force to reduce electrical resistance. However, the terminals of the conventional battery receptacle connector are fixed to a dielectric housing by several projecting points formed on T-shaped legs of the terminals, which is insufficient to provide proper engagement.

Another pertinent battery receptacle connector is disclosed in Taiwan Patent Application 83107591. Although terminals of the battery receptacle connector are firmly fixed to a dielectric housing, the terminals are engaged at a single contact point thereby providing insufficient contact area which does not promote proper battery receptacle connector performance.

Yet another conventional battery receptacle connector is disclosed in Taiwan Patent Application No. 83209060. Each terminal of the battery receptacle connector forms a double contact beam which clamps a mating terminal. However, the double contact beam is substantially a narrow cantilevered arm extending from the terminal, thereby exposing the terminals to large repeated insertions/withdrawals of the connector, and providing an insufficient normal contact force.

Therefore, conventional battery receptacle connectors can not satisfy the requirements of large contact area, sufficient normal contact force nor reliable positioning.

BRIEF SUMMARY OF THE INVENTION

A main object of the present invention is to provide a battery receptacle connector having a plurality of terminals, each forming a double contact portion which can provide a double guiding insertion function for expanding the field of application of the battery receptacle connector.

Another object of the present invention is to provide a battery receptacle connector having a plurality of terminals forming a double contact portion which increases the contact area and normal contact force of the terminals for effectively decreasing contact impedance at the contact surfaces.

Another object of the present invention is to provide a battery receptacle connector having a plurality of terminals which can be fixed in a dielectric housing from more than one direction thereby preventing the terminals from being adversely affected by deflection or mechanical shock during connection.

In accordance with one aspect of the present invention, a battery receptacle connector comprises an elongate dielectric housing and a plurality of terminals received in the housing. The housing defines a plurality of spaced terminal receiving grooves parallel to each other.

Each terminal comprises a base, a tail portion, positioning means comprising first and second positioning members, a pair of cantilevered arms, and mating means comprising first and second mating members. A free end of the first positioning member is shaped like an arrowhead. A pair of barbs is formed on a lateral edge of each second positioning member. The cantilevered arms of each terminal extend upwardly from and inwardly incline toward each other. The first mating members extend and incline outward from the cantilevered arms, while the second mating members extend from a junction of the cantilevered arms joined by the first mating members. The first and second mating members are substantially perpendicular to each other, thereby allowing the battery receptacle connector to engage with a mating plug connector in more than one direction. Furthermore, the first and second positioning members secure the terminals in the housing thereby preventing the terminals from being adversely affected by deflection or mechanical shock.

Other objects, advantages and novel features of the invention will become more apparent from the following detailed description when taken in conjunction with the accompanying drawings.

DETAILED DESCRIPTION OF THE INVENTION

Figure 1:
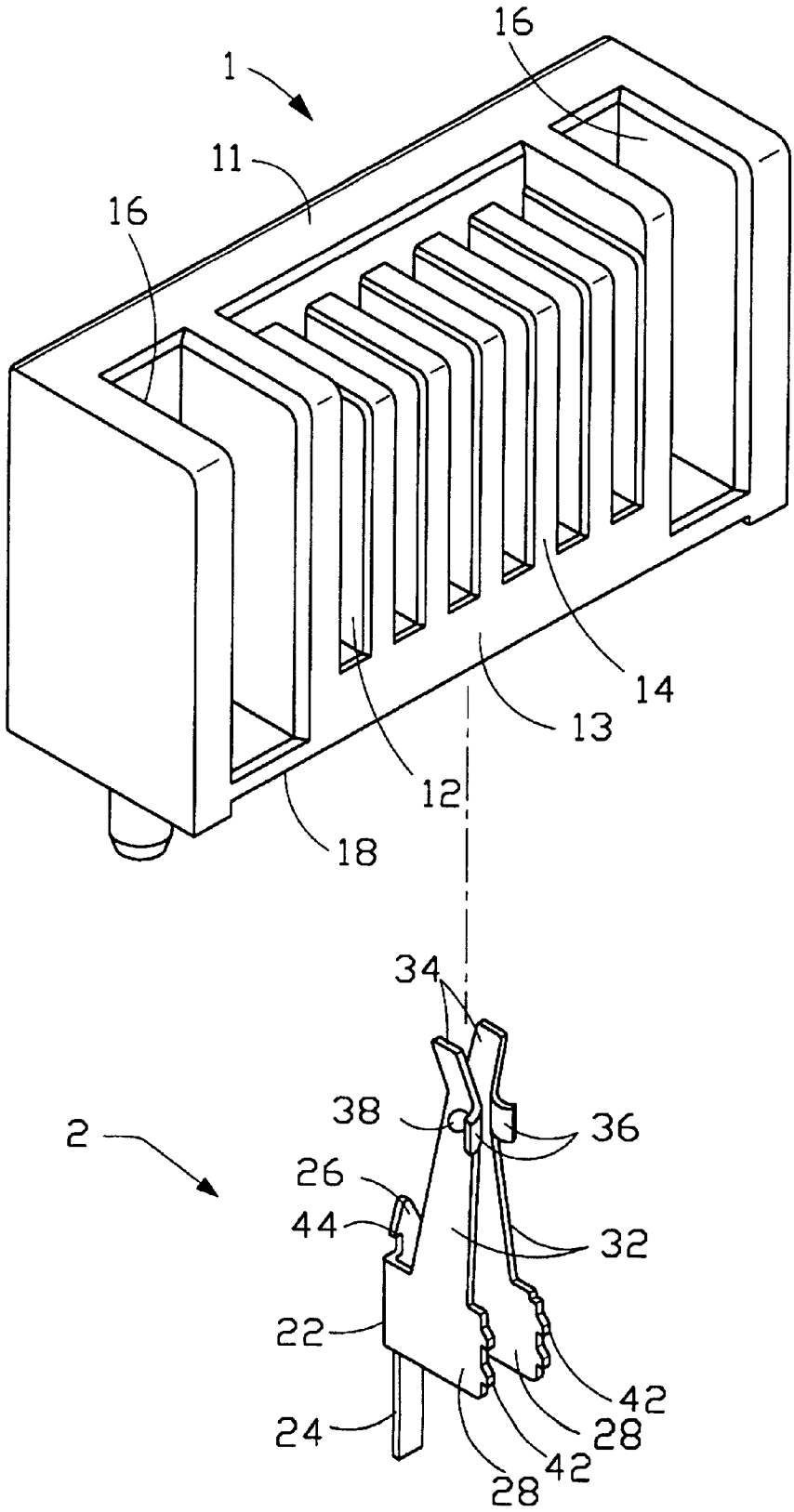
FIG. 1 is a perspective view of a dielectric housing and a terminal of a battery receptacle connector in accordance with the present invention.

Referring to FIG. 1, a battery receptacle connector in accordance with the present invention comprises a dielectric housing 1 and a plurality of conductive terminals 2.

The housing 1 defines a plurality of terminal receiving grooves 12 between a front wall 13 and a rear wall 15 for receiving the terminals 2 therein and a pair of mating slots 16 in opposite ends thereof for engaging with a mating plug connector (not shown). Each engaging slot 16 and terminal receiving groove 12 are exposed to a top surface 11 and a bottom surface 18 of the housing 1. The terminal receiving grooves 12 are parallel to each other and a partition 14 is formed between adjacent terminal receiving grooves 12 for electrically spacing the terminals 2 received therein.

Figure 3:
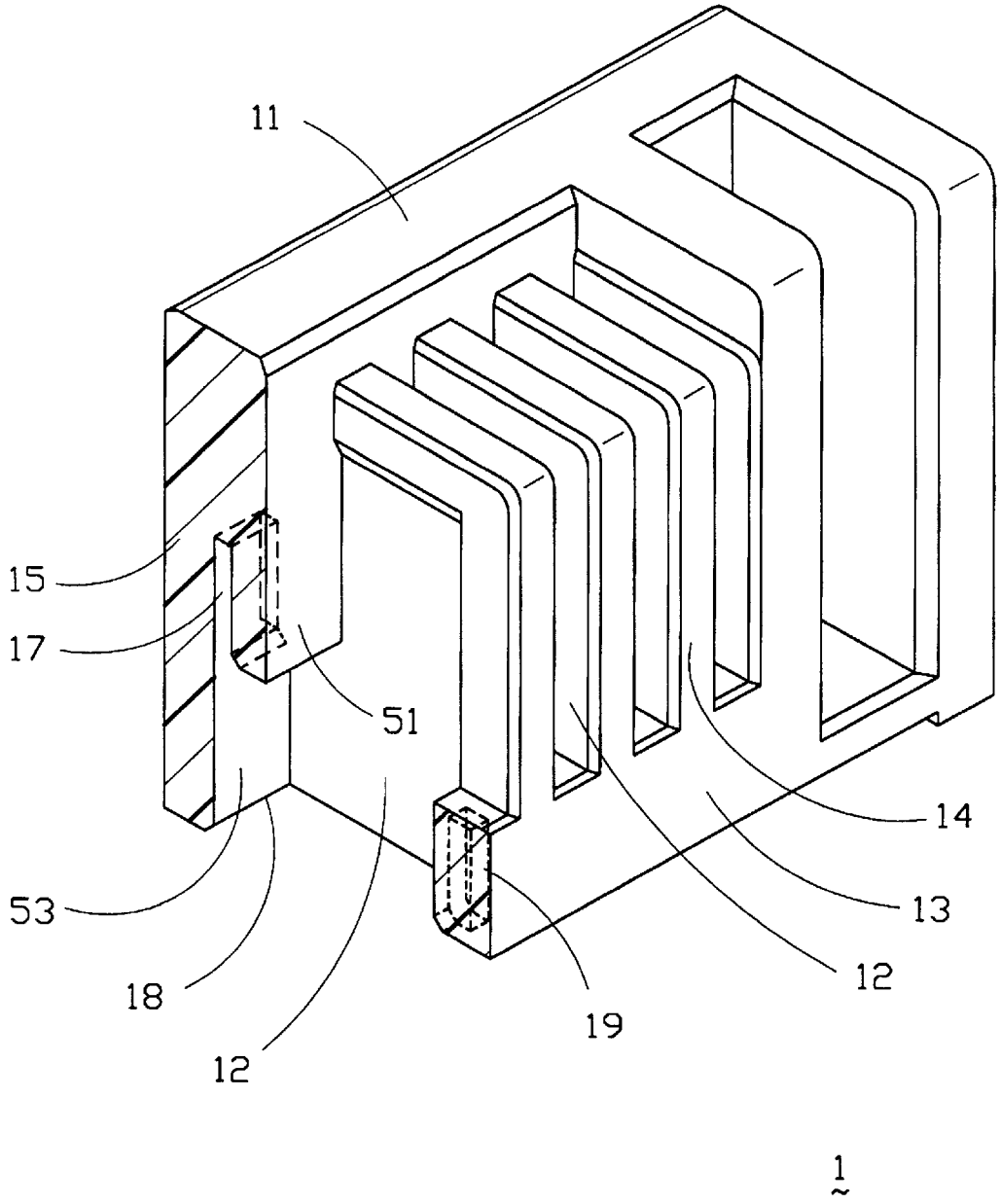
FIG. 3 is an enlarged cross-sectional view of FIG. 1.

Also referring to FIG. 3, a step portion 51 integrally and outwardly extends from the rear wall 15 in each groove 12 and is distanced from the bottom surface 18 thereby defining chamber 53. A first engaging slot 17 is defined between an inner surface of each step portion 51 and the rear wall 15 of the housing. A second engaging slot 19 is defined in the front wall 13 and in each groove 12, respectively. The first and second engaging slots 17, 19 both communicate with the corresponding grooves 12, and compose an engaging means of the housing 1 for engaging with the corresponding terminal 2.

Figure 2:
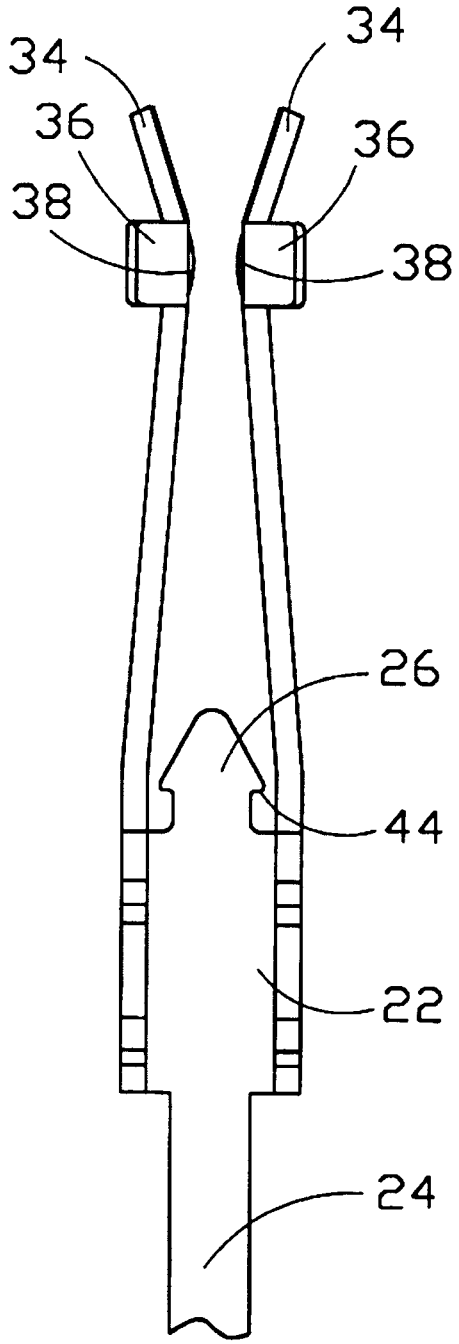
FIG. 2 is an elevational view of the terminal of the present invention.

Also referring to FIG. 2, each terminal 2 comprises a U-shaped base 22, a tail portion 24 downwardly extending from the base 22 for electrically connecting with a circuit board (not shown), and positioning means integrally extending from the base 22 for retaining the terminal 2 in the corresponding terminal receiving groove 12. The base is received in the corresponding chamber 53 of the housing 1. The positioning means comprises a first positioning member 26 upwardly extending from the base 22 opposite to the tail portion 24, and a pair of second positioning members 28 extending from opposed lateral edges of the base 22. A free end of the first positioning member 26 is shaped like an arrowhead thereby forming a pair of tips 44 in opposite edges of the first position member for engaging within the first engaging slot 17 of the housing 1. Each second positioning member 28 forms a pair of barbs 42 on a lateral edge thereof for interferentially fitting within the corresponding second engaging slot 19 of the housing 1.

A pair of cantilevered arms 32 upwardly extend from the base of the terminal 2 and incline toward each other. A pair of first mating members 34 upwardly extend from the cantilevered arms 32 and outwardly incline to define a first narrow mating entry (not labeled) therebetween for engaging with a corresponding contact of the mating plug connector. A pair of second mating members 36 horizontally extend from lateral edges of the cantilevered arms 32 adjacent to the first mating members 34. The second mating members 36 outwardly incline away from each other thereby defining a second narrow mating entry (not labeled) for insertion of a corresponding contact of the mating plug connector. The second mating members 36 are substantially perpendicular to both the cantilevered arms 32 and the first mating members 34. The first and second mating members 34, 36 constitute mating means for each terminal 2 to effectively guide electrical connection of the mating plug connector in more than one direction. The mating means of each terminal 2 further comprises a pair of projections 38 protruding from opposite inner surfaces of a junction between the first mating members 34 and the second mating members 36 into the first mating entry. The projections 38 extend toward each other to engage the corresponding contact of the mating plug connector.

In assembly, the terminals 2 are inserted into the corresponding terminal receiving grooves 12 from the bottom surface 18 of the housing 1. The first and second positioning members 26, 28 respectively engage within the corresponding first and second engaging slots 17, 19 of the housing 1 thereby securing the terminals 2 within the corresponding terminal receiving grooves 12. When the first positioning members 26 touch the top inner surfaces of the corresponding first engaging slots 17, the corresponding terminals 2 are properly positioned within the corresponding terminal receiving grooves 12. Thus, the positioning means of each terminal 2 reliably anchors each terminal 2 in the housing 1 in more than one direction thereby firmly fixing the terminal 2 in the groove. The first mating members 34 are disposed proximate the top surface 11 while the second mating members 36 are disposed proximate the front surface 13 of the housing 1 thereby permitting the mating plug connectors to mate with the battery receptacle connector from more than one direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery receptacle connector comprising:

a dielectric housing comprising a top surface, a bottom surface, a front wall, a rear wall, a plurality of partitions, and a plurality of terminal receiving grooves each defined by two adjacent partitions and the rear and the front walls, the plurality of terminal receiving grooves being in communication with the top surface, the bottom surface and the front wall; and a plurality of terminals received in corresponding ones of the terminal receiving grooves, each terminal comprising:

a base, a tail portion downwardly extending from the base for electrically connecting with a circuit board, positioning means comprising a first positioning member upwardly extending from the base and opposite to the tail portion, and a second positioning member forwardly extending from the base, a pair of cantilevered arms upwardly extending from the base, and mating means comprising a pair of first mating members and a pair of second mating members for mating with corresponding pins of a mating plug connector in more than one direction.

2. The battery receptacle connector as claimed in claim 1, wherein the first mating members upwardly extend from the cantilevered arms, outwardly incline away from each other, and form a first narrow mating entry for insertion of a corresponding contact of the mating plug connector.

3. The battery receptacle connector as claimed in claim 1, wherein the second mating members horizontally extend from opposite lateral edges of the cantilevered arms and outwardly incline away from each other thereby defining a second narrow mating entry therebetween for insertion of a corresponding contact of the mating plug connector.

4. The battery receptacle connector as claimed in claim 2, wherein a pair of projections protrude from opposed inner surfaces of a junction between the first mating members and the second mating members into at least the first narrow mating entry for electrically engaging with the contact.

5. The battery receptacle connector as claimed in claim 1, wherein a step portion projects from the rear wall of the dielectric housing into the corresponding terminal receiving groove and is distanced from the bottom surface thereby defining a receiving chamber for receiving the base of the corresponding terminal.

6. The battery receptacle connector as claimed in claim 5, wherein a first engaging slot is defined in each terminal receiving groove between the step portion and the rear wall of the dielectric housing for securing the first positioning member of corresponding terminal therein.

7. The battery receptacle connector as claimed in claim 6, wherein the first positioning member of each terminal is arrowhead-like and forms a pair of tips on opposite side edges thereof for engaging within the corresponding first engaging slot of the dielectric housing.

8. The battery receptacle connector as claimed in claim 1, wherein a second engaging slot is defined in each terminal receiving groove in the front wall for securing the second positioning member of the corresponding terminal therein.

9. The battery receptacle connector as claimed in claim 8, wherein the second positioning member forms at least a pair of barbs on a lateral edge thereof for engaging within the corresponding second engaging slot of the dielectric housing.

10. A battery receptacle connector comprising:

a dielectric housing defining a plurality of parallel terminal receiving grooves separated by partitions, an upper first engaging slot and a lower second engaging slot being defined in and communicating with each terminal receiving groove; and a plurality of terminals received in corresponding ones of the terminal receiving grooves and comprising each:

a base, a tail portion downwardly extending from the base, and positioning means comprising a first positioning member upwardly extending from the base for anchoring within the corresponding first engaging slot, and a second positioning member horizontally extending from the base for anchoring within the corresponding second engaging slot, thereby providing the terminal with multi-directional anchoring positions in the dielectric housing for preventing the terminals from becoming adversely affected by deflection and mechanical shock during connection;

wherein a step portion projects from a rear wall of the dielectric housing into the corresponding terminal receiving groove and is distanced from a bottom face of the housing thereby defining a receiving chamber for receiving the base of the corresponding terminal;

wherein the first engaging slot of each terminal receiving groove is defined between the step portion and the rear wall of the dielectric housing, and the first positioning member of each terminal is arrowhead-like and forms a pair of tips on opposite side edges for anchoring within the corresponding first engaging slot;

wherein the second engaging slot of each terminal receiving groove is defined proximate a front end of the corresponding partition, the second positioning member of each terminal forming at least a pair of barbs thereon for anchoring within the corresponding second engaging slot.

11. A conductive terminal comprising:

a base;

a tail portion downwardly extending from the base for electrically connecting with a mating electrical element;

a first positioning member upwardly extending from the base, and a second positioning member forwardly extending from the base;

a pair of cantilevered arms upwardly extending from the base toward each other; and a mating portion extending from each cantilevered arm, the mating portion comprising an upwardly extending first mating member and an laterally extending second mating member substantially perpendicular to the first mating member;

wherein the first positioning member is arrowhead-like and forms a pair of tips on opposite side edges thereof;

wherein the second positioning member forms at least a pair of barbs on a lateral edge thereof;

wherein a pair of projections protrude from opposed inner surfaces of a junction between the first mating members and the second mating members into a narrow mating entry defined between the first mating members for electrically engaging with a corresponding contact of the mating plug connector.

* * * * *